US009394077B2

(12) United States Patent
Weyrauch

(10) Patent No.: US 9,394,077 B2
(45) Date of Patent: Jul. 19, 2016

(54) PALLET LIQUID CONTAINER

(71) Applicant: MAUSER-WERKE GMBH, Brühl (DE)

(72) Inventor: Detlev Weyrauch, Kreuzau-Untermaubach (DE)

(73) Assignee: MAUSER-WERKE GMBH, Brühl (DE)

( * ) Notice: Subject to any disclaimer, the term of this patent is extended or adjusted under 35 U.S.C. 154(b) by 0 days.

(21) Appl. No.: 14/430,117

(22) PCT Filed: Sep. 13, 2013

(86) PCT No.: PCT/EP2013/002764

§ 371 (c)(1),
(2) Date: Mar. 20, 2015

(87) PCT Pub. No.: WO2014/044375

PCT Pub. Date: Mar. 27, 2014

(65) Prior Publication Data

US 2015/0246748 A1 Sep. 3, 2015

(30) Foreign Application Priority Data

Sep. 21, 2012 (DE) ..... 20 2012 009 327
Jan. 18, 2013 (DE) ..... 20 2013 000 624

(51) Int. Cl.
*B65D 19/06* (2006.01)
*B65D 77/04* (2006.01)
(Continued)

(52) U.S. Cl.
CPC ..... *B65D 19/06* (2013.01); *B65D 19/10* (2013.01); *B65D 19/385* (2013.01); *B65D 19/40* (2013.01);
(Continued)

(58) Field of Classification Search
CPC ..... B65D 19/06; B65D 19/10; B65D 19/385; B65D 19/40; B65D 19/44; B65D 2519/00024; B65D 2519/00079; B65D 2519/00164; B65D 2519/00273; B65D 2519/00288; B65D 2519/00407; B65D 2519/00512; B65D 2519/00552; B65D 2519/0083; B65D 77/0466; B29C 65/02
USPC ..... 206/386, 599; 220/9.1–9.4, 601
See application file for complete search history.

(56) References Cited

U.S. PATENT DOCUMENTS 5,253,777 A 10/1993 Schutz
5,673,630 A 10/1997 Schutz
(Continued)

FOREIGN PATENT DOCUMENTS

CH EP 2520512 A1 * 11/2012 ..... B65D 77/0466
DE 41 08 399 3/1991
(Continued)

OTHER PUBLICATIONS

International Search Report issued by the European Patent Office in International Application PCT/EP2013/002764.

*Primary Examiner* — Bryon Gehman
(74) *Attorney, Agent, or Firm* — Henry M. Feiereisen LLC

(57) ABSTRACT

A pallet container for storing and transporting liquid filling materials includes an plastics inner container and a supporting casing which closely encloses the plastics inner container and is made of a tubular lattice frame which is fastened to an upper outer rim of the pallet. The pallet has a flat pallet top deck for supporting the inner container, and a pallet substructure having four corner feet and four middle feet arranged there between, and a horizontally peripheral bottom ring. The pallet top deck is made of a flat, planar rectangular metal plate which has on each outer side a short downward-facing folded edge extending along the outer sides. The folded edge is pressed by the tubular lattice frame against the corner and middle feet into a folded-edge conforming recess and is fixed such that the metal plate is spanned at its four outer sides linearly on the pallet substructure.

10 Claims, 4 Drawing Sheets

(51) Int. Cl.

| | |
|---|---|
| ***B65D 19/38*** | (2006.01) |
| ***B65D 19/10*** | (2006.01) |
| ***B65D 19/40*** | (2006.01) |
| ***B65D 19/44*** | (2006.01) |

(52) U.S. Cl.

CPC ..... *B65D 19/44* (2013.01); *B65D 77/0466* (2013.01); *B65D 2213/02* (2013.01); *B65D 2519/00024* (2013.01); *B65D 2519/00059* (2013.01); *B65D 2519/00079* (2013.01); *B65D 2519/0083* (2013.01); *B65D 2519/00094* (2013.01); *B65D 2519/00104* (2013.01); *B65D 2519/00164* (2013.01); *B65D 2519/00174* (2013.01); *B65D 2519/00273* (2013.01); *B65D 2519/00288* (2013.01); *B65D 2519/00333* (2013.01); *B65D 2519/00373* (2013.01); *B65D 2519/00407* (2013.01); *B65D 2519/00512* (2013.01); *B65D 2519/00552* (2013.01); *B65D 2519/00567* (2013.01); *B65D 2519/00572* (2013.01)

(56) References Cited

U.S. PATENT DOCUMENTS

| | | | | |
|---|---|---|---|---|
| 5,738,240 | A | 4/1998 | Vavra | |
| 6,644,220 | B2 | 11/2003 | Gangloff | |
| 6,719,164 | B2 | 4/2004 | Maschio | |
| 7,017,499 | B2 | 3/2006 | Schütz | |
| 7,296,374 | B2 * | 11/2007 | Weyrauch | G09F 7/18 220/9.1 |
| 7,908,980 | B2 | 3/2011 | Schmidt | |
| 8,505,721 | B2 * | 8/2013 | Schutz | B65D 77/0466 206/386 |
| 8,708,150 | B2 * | 4/2014 | Schutz | B65D 21/0213 206/386 |
| 8,863,978 | B2 * | 10/2014 | Przytulla | B65D 77/0466 206/386 |
| 8,919,562 | B2 * | 12/2014 | Schutz | B65D 19/0073 206/599 |
| 2006/0011637 | A1 * | 1/2006 | Schmidt | B29C 65/02 220/601 |
| 2009/0008397 | A1 * | 1/2009 | Schmidt | B29C 65/02 220/601 |
| 2010/0200579 | A1 * | 8/2010 | Schmidt | B29C 65/02 220/1.6 |

FOREIGN PATENT DOCUMENTS

| | | |
|---|---|---|
| DE | 42 06 945 | 3/1992 |
| DE | 202006001222 | 7/2007 |
| DE | 100 60 920 | 5/2008 |
| EP | 0 673 846 | 3/1995 |
| EP | 1 232 961 | 2/2002 |
| EP | 1 426 299 | 6/2004 |
| EP | 1 982 924 | 10/2008 |
| WO | WO 2012/085941 | 7/2012 |

* cited by examiner

PALLET LIQUID CONTAINER

CROSS-REFERENCES TO RELATED APPLICATIONS

This application is the U.S. National Stage of International Application No. PCT/EP2013/002764, filed Sep. 13, 2013, which designated the United States and has been published as International Publication No. WO 2014/044375 and which claims the priorities of German Patent Applications, Serial No. 20 2012 009 327.4, filed Sep. 21, 2012, and Serial No. 20 2013 000 6242, filed Jan. 18, 2013, pursuant to 35 U.S.C. 119(a)-(d).

BACKGROUND OF THE INVENTION

The present invention relates to a pallet container for storing and transporting in particular hazardous liquid filling materials, having an exchangeable plastics inner container and a supporting casing which closely encloses the plastics inner container and is made of a tubular lattice frame which is fastened to the upper outer rim of the pallet, wherein the rectangular pallet has a flat pallet top deck for supporting the fitted plastics inner container, and a pallet substructure having four corner feet and four middle feet arranged therebetween, and a horizontally peripheral bottom ring (rectangular base ring). The pallet is equipped, between the pallet top deck and the peripheral bottom ring and between the corner and middle feet with in each case a corresponding recess for the insertion of the forks of a fork-lift truck. The pallet can be passed beneath from all four sides in the longitudinal or transverse direction. Filled pallet containers having a filling volume of approximately 1000 liters with a conventional pallet size of 1200 mm×1000 mm can have a weight of well over 1 t, depending on the specific weight of the liquid filling material, and are only able to be handled with fork-lift trucks. In this case, the shorter pallet sides (1000 mm) are designated the front and rear sides and the two longer pallet sides (1200 mm) are designated the longitudinal sides. An extraction fitting is conventionally arranged centrally in the front side at the bottom of the plastics inner container.

PRIOR ART

Such pallets and pallet containers IBC) are well known in different variant embodiments from different manufacturers, for example from the documents EP-A 0 673 846 (Sch.), EP-A 1 426 299 (SCH), EP-A 1 232 961 (Mm.), EP-A 1 982 924 (Fu.) or DE-A 100 50 920 (So.).

The document DE-A 41 08 399 (Sch.) describes a pallet container having a steel pallet which has a sheet-steel top adapted to the discharging bottom of the inner container, said discharging bottom being inclined toward the middle of the pallet and toward the front, said top being in the form of a bottom tray for receiving the inner container in a form-fitting manner. Externally, the bottom tray has a peripheral upwardly projecting supporting wall and in the support surface for the inner container it has downwardly indented reinforcing beads with a decreasing height, the bead undersides of which lie in a common horizontal plane in order to act as a support for the forks of a fork-lift truck when the pallet container is transported. In another embodiment of a pallet container, known from DE-A 42 06 945 (Sch.), the bottom tray has an upwardly extended outer supporting rim which is formed with a flat base in the region of the reinforcing beads to form a hollow-chamber bottom with closed or open chambers. DE 42 06 945 discloses a pallet container having a solid reinforcing metal sheet fastened transversely, under the bottom tray in the manner of a bridge joist or a cross member, wherein two middle feet are integrally formed at the ends of the bridge-like reinforcing metal sheet and the reinforcing metal sheet is formed together with the two middle feet as a deep-drawn sheet-steel profile part.

Disadvantages of the Prior Art

During the transportation of pallet containers by way of transportation vehicles, for example trucks or fork-lift trucks, the liquid sloshing back and forth continuously produces dynamic swashing vibrations which exert a continuous load on the pallet container or the tubular lattice frame and the pallet. In addition, the pallet is subjected to alternating bending stresses on account of travel vibrations originating from the transportation vehicle. These various stresses are so great in the pallet containers known from the prior art that in each case a solid cross beam has to be introduced under the bottom tray or under the pallet top deck in order to ensure transportation safety. Often, in these known pallet designs, the bottom-tray region sags in front of and behind the bridge-like reinforcing cross member, with the result that the emptying of residues through the front-side extraction fitting is considerably impaired. The "sagging" of the bottom tray on account of the surface vertical loading by the filled inner container is favored by the external wall elevations of the known pallets having a sheet-steel bottom tray, which react in a concertina-like manner to the perpendicular loading and accordingly yield in the horizontal direction toward the middle of the pallet.

Objective

The invention is based on the object of further developing and improving a pallet container having a particular bottom pallet with regard to greater transportation safety, of overcoming the disadvantages of the prior art and of proposing a simplification of the design with the aim of more economical manufacture.

Solution

This object is achieved according to the present invention by a pallet container for storing and transporting in particular hazardous liquid filling materials, having an exchangeable plastics inner container and a supporting casing which closely encloses the plastics inner container and is made of a tubular lattice frame which is fastened to the upper outer rim of the pallet, wherein the rectangular pallet has a flat pallet top deck for supporting the fitted plastics inner container, and a pallet substructure having four corner feet and four middle feet arranged there between, and a horizontally peripheral bottom ring (rectangular base ring), wherein the pallet top deck includes a flat, planar rectangular metal plate which is free of any upwardly projecting formations, for example reinforcing beads in the surface plane or external wall elevations, and which has on each of its four outer sides a short downward-facing right-angled folded edge extending along the outer sides, the folded edge being pressed, by the tubular lattice frame that is positioned from above with its bottommost horizontally peripheral frame tube against the corner and middle feet arranged beneath the metal plate, into a recess that is provided there and is adapted to the folded edge, and being fixed such that the planar rectangular metal plate is spanned externally in a linear manner on the pallet substructure.

In the pallet container according to the invention, the pallet top deck consists of a flat, planar rectangular metal plate which has on each of its four outer sides a right-angled folded edge that faces downward over a short section, said folded edge being pressed, by the tubular lattice frame that is positioned from above with its bottommost horizontally peripheral frame tube against the corner and middle feet arranged beneath the metal plate, into a recess that is provided there and is adapted to the folded edge, and being fixed laterally such that the planar rectangular metal plate is practically spanned externally in a linear manner on the pallet substructure.

In the case of pure steel pallets, the metal plate can be welded directly to the frame-like pallet substructure (steel tubular frame, sheet-steel pallet feet) in the region of the peripheral folded edge.

For pallets having a frame-like pallet substructure made of wood or plastics material or combinations thereof or composite pallets (plastics feet with sheet-steel base tube), provision is made in a further configuration for the short right-angled downward-facing folded edges that extend along the outer sides each to have a further short right-angled folded edge that extends in the horizontal direction, said further folded edge being covered by the tubular lattice frame positioned from above with its bottommost horizontally peripheral frame tube, and resting against the bottom surface of the recess that is arranged beneath the metal plate externally along the corner and middle feet and is adapted to the folded edge, and being fixed such that the planar rectangular metal plate is spanned tautly in the manner of a trampoline externally in a linear manner on the pallet substructure. As a result of the doubled L-shaped externally peripheral downward-facing folded edge and the positioning of the tubular lattice frame, which is firmly connected or screw-connected to the frame-like pallet substructure, doubled form- and force-fitting fixing of the metal plate is ensured, and sagging in the event of loading by filled inner containers is quite considerably reduced.

In this case, the inner container rests flat on the bottom pallet or the planar pallet top deck, which consists here of the spanned metal plate made of thin galvanized sheet steel and is completely free of any upwardly projecting formations, for example reinforcing beads in the surface plane, surface inclinations or external wall elevations. There can no longer be any question of a bottom tray adapted to the bottom of the plastics inner container—as was previously conventional in known pallet containers.

The bottommost horizontally peripheral lattice tube of the tubular frame is located beneath the planar base surface of the pallet top deck in an externally peripheral bearing surface which consists of the folded edge(s) of the metal plate, and fixes the bottom metal sheet to a supporting structure formed from tubes, and to the four corner feet and the middle feet located in each case therebetween (there is no central middle foot). The supporting structure, consisting of tubes, has tubes that extend in two planes, wherein the upper plane extends directly beneath the planar metal plate in a manner virtually flush with the top side and the lower plane extends in a manner virtually flush with the underside of the pallet feet. On account of the externally peripheral spanning of the metal plate on the pallet top side and the tubes, extending directly beneath the metal plate, in the upper plane of the supporting structure, sagging of the pallet top deck or in the bearing surface of the plastics inner container is avoided, with the result that consistent emptying of residues from the inner container is ensured.

In one configuration of the invention, provision is made for the pallet substructure to be formed as a tubular-frame supporting structure which has, in a parallelogram-like manner, four tubes that extend in a diamond-shaped manner with respect to one another in an upper plane directly beneath the metal plate, and has a rectangular peripheral base tube in a lower plane, wherein the tubes of the upper plane are connected to the base tube in the lower plane via four corner feet and four middle feet located therebetween. In this case, the four tubes that extend in a diamond-shaped manner with respect to one another are downwardly angled at their ends and are connected or screw-connected to the base tube via these angled tube ends, which are each plugged into two adjacent middle feet. The four tubes that extend in a diamond-shaped manner in the upper plane of the tubular-frame supporting structure represent a kind of die for the middle feet, which are thus retained in their intended position even in the event of high loads and effect the "spanning" of the thin metal plate.

In a preferred configuration of the invention, in addition to the four tubes that extend in a diamond-shaped manner, the tubular-frame supporting structure has two further parallel transverse tubes in the upper plane directly beneath the metal plate, said transverse tubes each being mounted and fastened in the two lateral middle feet of the longer pallet sides.

In another embodiment, instead of the transverse tubes, it is also possible for provision to be made of two parallel longitudinal tubes which are then mounted in the front and rear middle foot. For a heavy-duty embodiment for liquid filling materials (e.g. sulfuric acid) having a high specific weight, it is also possible for provision to be made of longitudinal and transverse tubes for reinforcing the tubular-frame supporting structure.

Advantages of the Invention

The pallet top deck or the planar metal plate is considerably stabilized by the tubes, arranged directly therebeneath and extending diagonally or in a diamond-shaped manner in the upper plane and optionally in the transverse and/or longitudinal direction, as a spanned supporting structure with tubular rods that are rigid in compression and flexion. In the configuration of the pallet top deck or of the metal sheet, as a result of the direct support on the supporting tube system it is possible to dispense with the otherwise conventional numerous reinforcing beads and with the solid joist (cross member, transverse bridge) under the bottom tray or the pallet top deck as bearing beads for the forks of the fork-lift truck, because the forks of the fork-lift truck now no longer come into direct contact with the pallet top deck or the sheet-metal tray but rather in each case engage beneath only the upper tubes of the spanned supporting frame structure. Direct stressing and deformation of the metal plate by the forks of the fork-lift truck—as has been conventional previously in known bottom trays—is now ruled out.

Further Advantages

- with the composite pallet according to the invention, more uniform load distribution and introduction of loads into all corner and middle feet is achieved;
- the diamond-shaped supporting tube structure directly beneath the bottom plate introduces the bearing load directly into the base tube;
- the thin metal sheet or metal plate is firmly fixed and spanned and acts as a "trampoline" (elastically resilient and non-rigid and permanently deformable);
- the external L-shaped folded edges with the bent-over outer edges of the metal plate (inwardly bent punched rims) preclude a risk of injury because no sharp cut or punched edges are present;

the middle foot under the extraction fitting is formed in two pieces or with a double shell, with a lower base foot and an upper positioned drip pan as an exchangeable drip pan (two piece block), the top shell can be configured in an easily exchangeable manner, for example via a snap-latching connection;

the corner feet—compared with known corner feet—are embodied in an extended manner in the lateral direction, resulting in a reduction in the tilting moment and improved rigidity of the base ring.

The four diagonal tubes and also the two parallel tubes of the pallet supporting-tube frame, under which only the forks of the fork-lift truck engage, can expediently be coated with an anti-slip means (for example a section of rubber hose, a polyurethane coating or the like).

SM13 Bottom Plate

The top deck of the pallet is a thin "membrane" stretched in particular over the middle feet. This membrane is a rectangular metal sheet made of approximately 0.6 mm to 1 mm, preferably approximately 0.75 mm, thin galvanized sheet steel having a flat, completely planar and smooth surface (without any elevations, for example reinforcing beads in the surface plane or upwardly formed outer wall rims or upwardly projecting transversely extending central reinforcing ribs), into which only a central collecting channel that extends from rear to front to the extraction fitting and short beads, arranged symmetrically to one another, for protecting the upper supporting tube are downwardly formed. Beneath the metal sheet, a supporting tubular frame having integrated pallet feet (for example steel or plastics corner feet and middle feet) is arranged as the pallet substructure.

Force Introduction Via Lateral Folded Edges (15 mm Step)

The planar sheet-steel bottom plate is angled vertically downward in a right-angled and step-like manner around its entire outer rim and engages over the corner and middle feet with an approximately 15 mm high flanged rim (step); as a result, linear force introduction along the entire outer length of the corner and middle feet, no disadvantageous punctiform force introduction as in known IBC pallets via screws or pins; these folded edges are formed in a peripheral manner on the entire outer rim of the planar bottom plate. In the region of the straight side walls—with the exception of the rounded corner regions—the flanged rim is formed once again in a manner extended in an L-shaped manner and angled horizontally. At their upper outer rims, the corner and middle feet have a corresponding right-angled recess in the form of a longitudinal groove into which the angled L-shaped flanged rim fits exactly with its vertical and horizontal webs. The horizontal web is inwardly folded or flanged once again at its free outer edge and placed under the bottommost peripheral lattice-frame tube in order to reliably rule out a risk of cutting at the outer edge of the metal sheet (cutting-injury-free flanged edge).

In the mounted state, the lattice tube frame is inserted with a precise fit with its bottommost peripheral horizontal tube onto this angled flanged rim and into the right-angled set-back recess in the corner and middle feet and connected to the horizontally peripheral base tube for example by means of continuous screws through the corner and middle feet. As a result, the planar sheet-steel bottom plate is firmly clamped and fixed along the entire length of the lateral folded edges by the bottommost peripheral horizontal tube of the lattice tube frame, since the bottommost horizontal tube is screw-connected firmly to the base tube via the corner and middle feet.

SM13 Plastics Feet

In the reconditioning of a used IBC, the two-part front middle foot having a separate discharging depression allows said discharging depression to be exchanged by the reconditioner NCG if this discharging depression is contaminated. The two middle feet on the shorter pallet sides are formed in a manner extended inwardly by approximately 20 mm to 60 mm, this serving for better transportation or running on roller conveyors and for plugging in the two parallel supporting tubes, this also serving for better support and greater load distribution in the event of stacking in high-bay racking.

Tubular Frame the tubes extending in a diamond-shaped manner from the upper plane of the supporting structure are each angled at their ends and plugged into the four middle feet (not into the corner feet!).

with their angled ends that are plugged into the four middle feet, the tubes extending in a diamond-shaped manner from the upper plane are supported directly on the base ring and are firmly connected, preferably screw-connected, thereto.

The two transverse tubes in the upper plane of the tubular-frame supporting structure have a function as pressure tubes for stabilizing the end points (of the two lateral middle feet) for the diamond-shaped spanning of the thin pallet-top-deck metal plate. Similarly, in another configuration, the two longitudinal tubes serve to stabilize and support the end points (of the front and of the rear middle foot) for the diamond-shaped spanning of the thin metal plate. On the other hand, they serve, by way of their flexural rigidity, to support the metal plate in the longitudinal direction; to this end, the two longitudinal tubes extend closely laterally next to or parallel to the central discharging channel, which is impressed centrally in the longitudinal direction from above into the metal plate in a manner corresponding to the central discharging channel in the bottom of the plastics inner container. A further important function of the longitudinal and transverse tubes is that of stabilizing the middle feet on the pallet outer sides in order that these cannot "tip" on the base ring.

Each time the forks of a fork-lift truck are inserted, said forks engage in principle under the diamond-shaped tubes in the upper plane of the tubular-frame supporting structure, even in the case of an incomplete, only 80% insertion, such that the forks never come into contact with the thin metal plate, the pallet top deck. In the case of the conventional introduction of the forks from the front (in the longitudinal direction), they additionally also engage under the two transverse tubes. In order to prevent the pallet container from slipping on the forks of the fork-lift truck, these tubes can be provided with a corresponding anti-slip coating, for example a plastics or rubber coating.

BRIEF DESCRIPTION OF THE DRAWING

The invention is described and explained in more detail in the following text with reference to exemplary embodiments that are schematically illustrated in the drawings, in which.

DETAILED DESCRIPTION OF PREFERRED EMBODIMENTS

Figure 1:
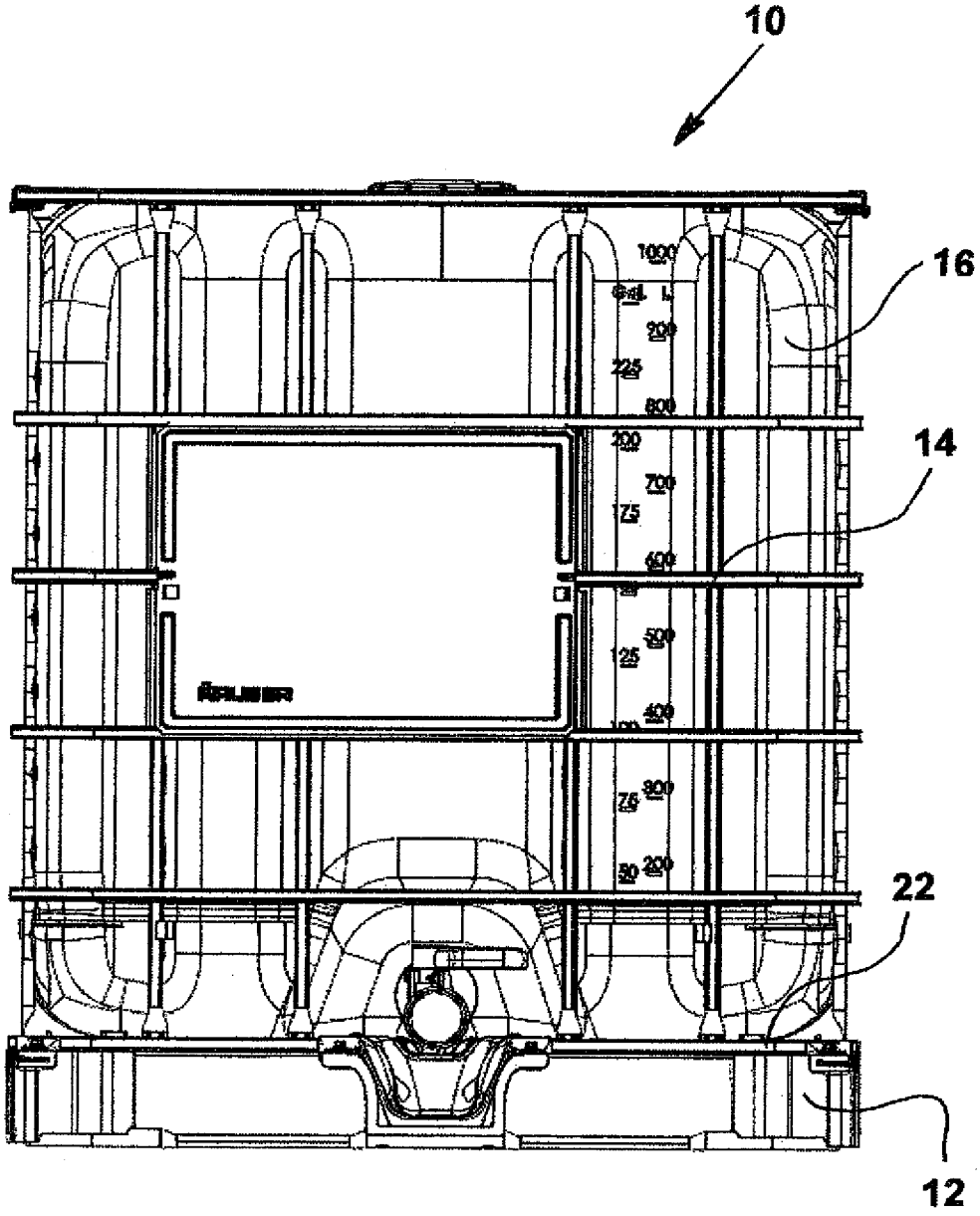
FIG. 1 shows a side view from the front of a pallet container according to the invention.

In FIG. 1, a pallet container of lightweight construction of the "composite IBC" (IBC=Intermediate Bulk Container) type is designated by the reference numeral 10. The pallet container 10 is provided with official hazardous-materials authorization for the storage and transportation of in particular hazardous liquid filling materials and has an exchangeable plastics inner container 16, a supporting casing which closely encloses the plastics inner container 16 and is made of a tubular lattice frame 14, and a bottom pallet 12. The tubular lattice frame 14 is fastened to the upper outer rim of the pallet 12, wherein the rectangular pallet 12 has a thin metal plate 18 as flat pallet top deck for supporting the fitted plastics inner container 16, and a pallet substructure having four corner feet 24 and four middle feet 26 arranged therebetween, and a horizontally peripheral bottom ring or rectangular base ring 34.

Figure 2:
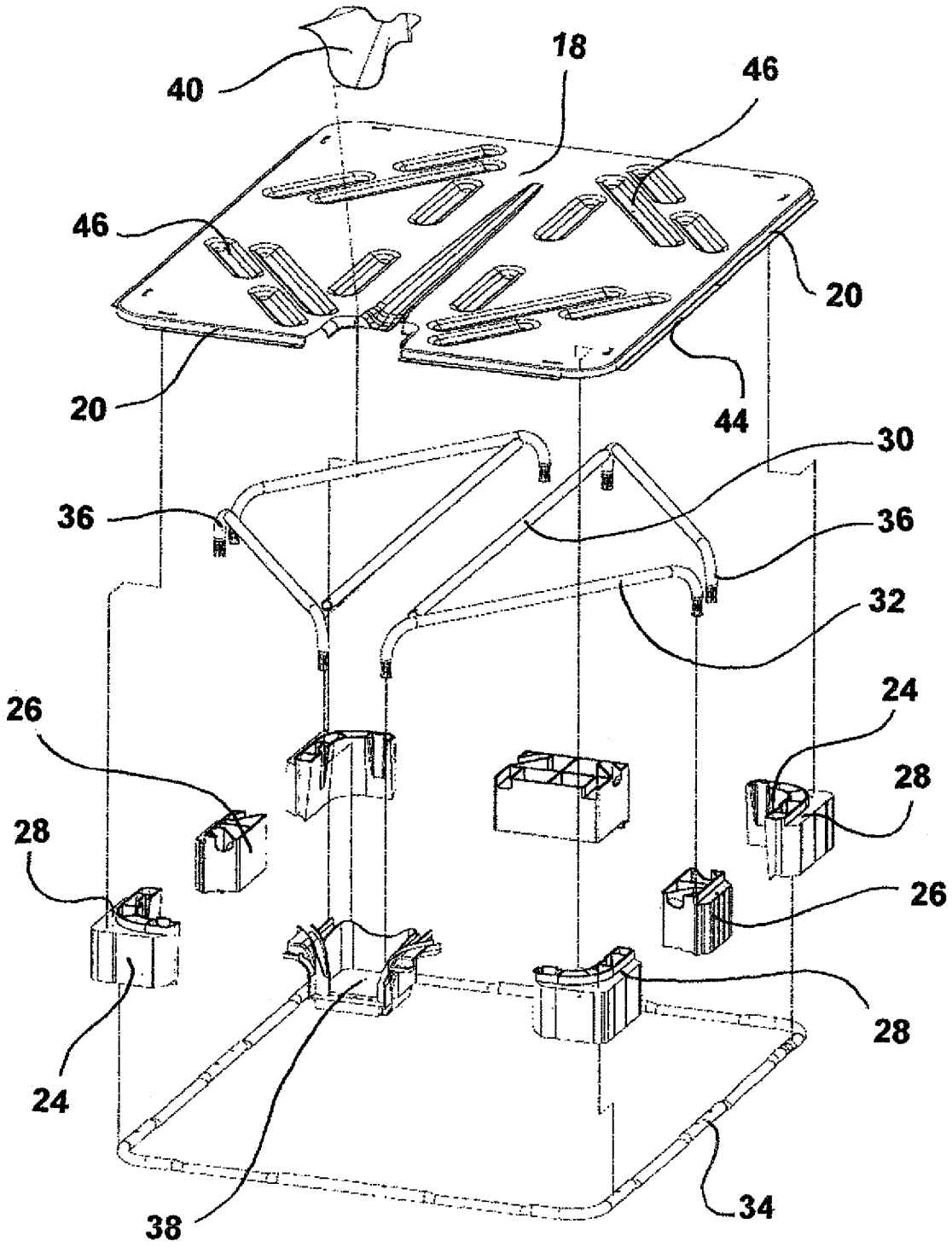
FIG. 2 shows a bottom pallet according to the invention with an exploded illustration of the individual components.

As is apparent from the exploded illustration of the bottom pallet 12 in FIG. 2, the metal plate 18 is formed in a completely flat and planar manner, without inclinations, slopes or upwardly projecting peripheral rim beads. The rectangular metal plate 18 has at each of its four outer sides a downward-facing folded edge 20 which is pressed, by the tubular lattice frame 14 that is positioned from above with its bottommost horizontally peripheral lattice-frame tube 22 against the corner feet 24 and middle feet 26 arranged beneath the metal plate 18, into a recess 28 that is provided there and is adapted to the folded edge 20, and fixed such that the planar rectangular metal plate 18 is spanned externally in a linear manner on the pallet substructure. The folded edge 20 has a further short right-angled L-shaped folded edge 44 that extends in the horizontal direction. In this case, the pallet substructure is formed as a tubular-frame supporting structure which has two parallel longitudinal tubes 30 and four tubes 32 that extend in a diamond-shaped manner with respect to one another in an upper plane directly beneath the metal plate 18, and a rectangular peripheral base tube 34 in a lower plane, wherein the tubes 30, 32 of the upper plane are connected to the base tube 34 in the lower plane via four corner feet 24 and the four middle feet 26 located therebetween. The four tubes 32 that extend in a diamond-shaped manner with respect to one another are downwardly angled at their ends and are connected, preferably screw-connected, to the base tube 34 via these angled tube ends 36, which are each plugged through two adjacent middle feet 26. The tubes 32 having the angled tube ends 36 are advantageously all formed in an identical manner for cost-effective manufacture. The front middle foot, which is arranged beneath the extraction fitting of the inner container, consists of two parts, specifically a cup-shaped lower part 38 and an obliquely formed bowl-shaped upper part 40.

The rectangular metal plate 18 has, in the region of the engagement means for the forks of a fork-lift truck, indentations 46 or what are referred to as beads that are introduced from the top downward; two lines of longitudinal beads extend parallel and closely adjacent to the central collecting channel; in each case two mutually parallel protective beads that extend overall diagonally but are formed in a comparatively short manner are impressed in all four quadrants. The central collecting channel in the metal plate 18 is formed in a manner corresponding to the conventional downwardly formed collecting channel in the bottom of the plastics inner container and is likewise indented downwardly into the metal plate 18. The likewise downwardly indented protective beads are intended to prevent the forks of a fork-lift truck from accidentally being able to engage between the thin metal plate 18 and the upper tube structure. These indentations 46 which are impressed parallel to the tubes of the upper supporting structure and are formed in a shallower manner than the diameter of the tubes thus represent a lateral protective wall for the tubes extending under the metal plate, such that incorrect insertion of the forks of a fork-lift truck is reliably prevented.

Figure 3:
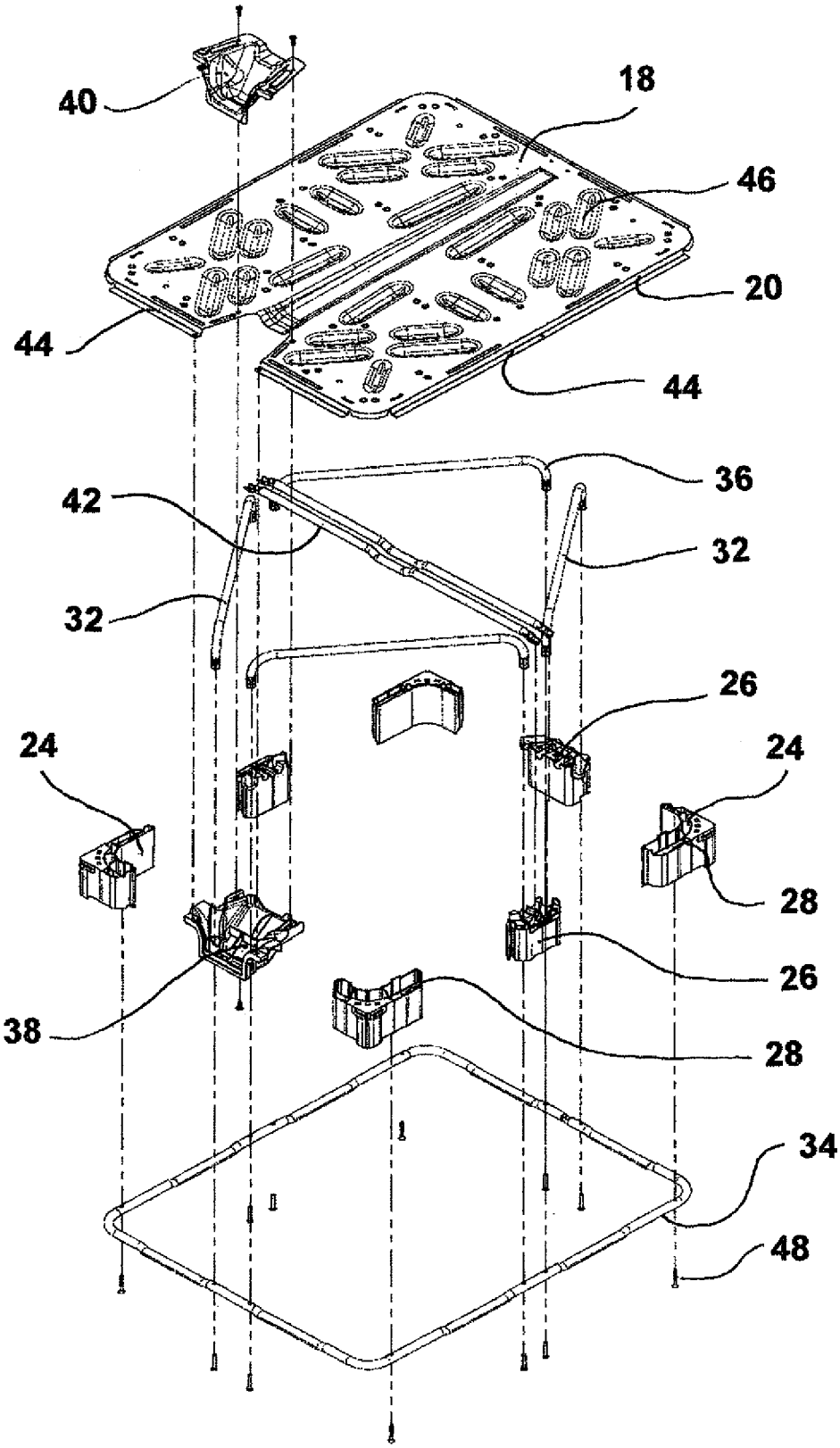
FIG. 3 shows a preferred embodiment of a bottom pallet according to the invention with an exploded illustration of the individual components.

FIG. 3 illustrates the preferred embodiment, in which, in contrast to FIG. 2, rather than the two longitudinal tubes 30, two parallel transverse tubes 42 are installed. The transverse tubes 42 are formed in a slightly arcuate manner over a short section in the central region, and they extend there transversely to the collecting channel indented in the metal plate 18. The ends of the transverse tubes 42 are mounted and fixed in the two middle feet 26 on the long lateral edges of the pallet. The anchoring of the metal plate 18 for the linear absorption of tensile forces takes place here, too, via the above-described angling of the metal-plate outer rim, which is fixed by the positioned lattice frame. In a corresponding construction, the upper metal sheet 18 is downwardly angled in each case in an L-shaped manner at its straight lateral edges and is screw-connected to the pallet substructure by the positioned tubular lattice frame 14 by way of the corner and middle feet 24, 26; a central middle foot is neither required nor provided. The slightly angled ends of the transverse tubes 42 are placed in a form-fitting manner into corresponding recesses in the middle feet 26 and are firmly clamped by the firmly screw-connected bottommost lattice-frame tube 22 of the tubular lattice frame 14.

Figure 4:
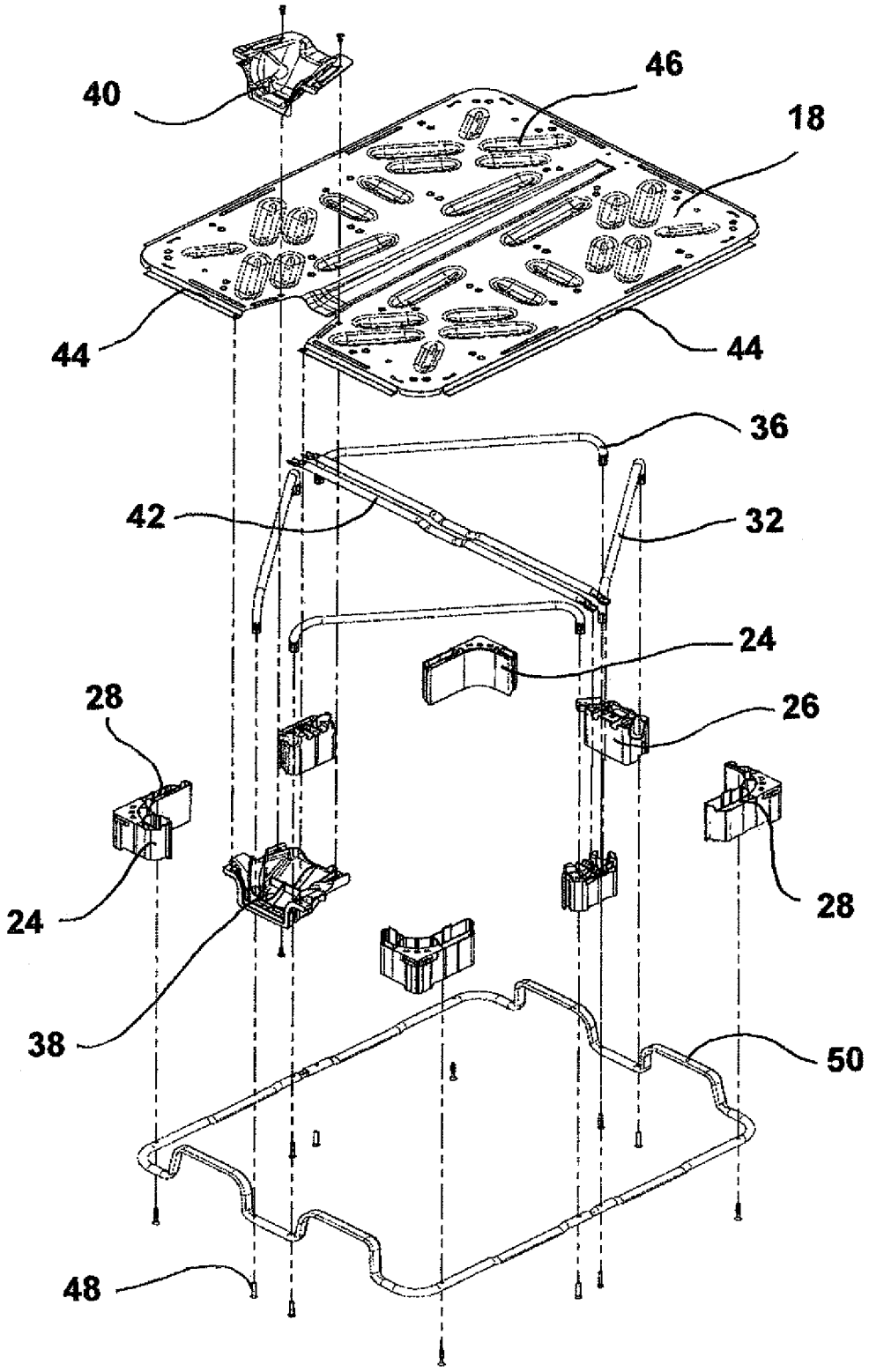
FIG. 4 shows a further bottom pallet according to the invention of the "easy entry" type with an exploded illustration of the individual components.

A further embodiment of the pallet container according to the invention, having a bottom pallet of the "easy entry" type, is illustrated in FIG. 4. Here, instead of the horizontally peripheral base tube 34, provision is made of a modified base tube 50 which is formed in an upwardly arcuate manner on the short pallet sides, i.e. at the front and rear, in the region of the engagement means for the forks of a fork-lift truck. This pallet version is suitable in particular for in-company transportation using scissor lift trucks which have a roller chassis extending under the forks and are not suitable for conventional pallets (having a flatly peripheral base tube).

With the embodiments according to the invention of the composite pallet SM13, compared with known pallet containers, in which the main load is transmitted by the two middle feet to the long pallet sides at the ends of the cross member, improved and more uniform load distribution to all pallet feet is achieved. As a result of the particular design with the better load distribution, the new pallet SM13 has less sagging overall than all other comparable known pallets that are available on the market.

What is claimed is:

1. A pallet container for storing and transporting hazardous liquid filling material, said pallet container comprising:

a pallet including a flat pallet top deck and a pallet substructure, said pallet substructure having a horizontally peripheral base tube, four corner feet, and four middle feet arranged between the corner feet, with the corner and middle feet defining a recess, said pallet top deck including a flat, planar metal plate defining four outer sides, each outer side including a downward-facing right-angled folded edge extending along the outer side and having a contour conforming to a contour of the recess, said metal plate being free of any upwardly projecting formation;

an exchangeable plastics inner container supported on the pallet top deck; and a supporting casing configured to closely enclose the inner container and made of a tubular lattice frame which is fastened to an upper outer rim of the pallet, said supporting casing having a horizontal bottom frame tube to press the metal plate of the pallet against the corner and middle feet into the recess and to fix the metal plate such that the metal plate is attached on an outside in a linear manner on the pallet substructure, wherein the pallet substructure is formed as a tubular-frame supporting structure which has a configuration in a shape of a parallelogram, said supporting structure including four tubes that extend in a diamond-shaped manner with respect to one another in an upper plane directly beneath the metal plate, with the base tube being arranged in a lower plane, with the tubes of the upper plane being connected to the base tube in the lower plane via the four corner feet and four middle feet.

2. The pallet container of claim 1, wherein the pallet has a rectangular configuration.

3. The pallet container of claim 1, wherein the bottom base tube is configured in the form of a rectangular base ring.

4. The pallet container of claim 1, wherein the metal plate has a rectangular configuration.

5. The pallet container of claim 1, wherein the four tubes have downwardly angled tube ends, with the tube ends of each of the four tubes respectively engaging into two adjacent middle feet, said four tubes being connected to the base tube via the tube ends.

6. The pallet container of claim 1, wherein the tubular-frame supporting structure has two further longitudinal tubes disposed in parallel relation in the upper plane directly beneath the metal plate, each said longitudinal tube being mounted and fastened in a front one of the middle feet beneath an extraction fitting and in a rear one of the middle feet.

7. The pallet container of claim 1, wherein the tubular-frame supporting structure has two further transverse tubes disposed in parallel relation in the upper plane directly beneath the metal plate, each said transverse tube being mounted and fastened in two lateral ones of the middle feet.

8. The pallet container of claim 1, wherein the folded edge has an L-shaped configuration with a further right-angled folded edge extending in a horizontal direction and covered from above by the tubular lattice frame with the horizontal bottom peripheral frame tube, said further folded edge resting against a bottom surface of the recess which extends beneath the metal plate externally along the corner and middle feet and is contoured to complement the folded edge so that the metal plate is spanned in the manner of a trampoline externally in a linear manner on the pallet substructure.

9. The pallet container of claim 1, wherein the metal plate has downward-facing indentations in lateral and parallel relation to the tubes, said indentations having a depth which is smaller than a diameter of the tubes.

10. The pallet container of claim 1, wherein the tubes are coated with an anti-slip agent.

* * * * *